US005485739A

United States Patent [19]

Grimmett

[11] Patent Number: 5,485,739

[45] Date of Patent: Jan. 23, 1996

[54] VIBRATING PIPE STRAIGHTENER

[76] Inventor: James G. Grimmett, 3027 16th Pl., Forest Grove, Oreg. 97116

[21] Appl. No.: 393,663

[22] Filed: Feb. 24, 1995

[51] Int. Cl.[6] ..... B21D 1/08

[52] U.S. Cl. ..... 72/466; 72/479; 72/710

[58] Field of Search ..... 72/466, 479, 710

[56] References Cited

U.S. PATENT DOCUMENTS

| | | | |
|---|---|---|---|
| 423,544 | 3/1890 | Vanderman | 72/466 |
| 1,752,799 | 4/1930 | Junkers | 72/466 |
| 2,545,878 | 3/1951 | Forrest | 72/466 |
| 4,727,745 | 3/1988 | Ferree | 72/479 |
| 4,771,627 | 9/1988 | Speakman | 72/710 |

FOREIGN PATENT DOCUMENTS

| | | | |
|---|---|---|---|
| 0389862 | 7/1973 | U.S.S.R. | 72/479 |

*Primary Examiner*—David Jones

[57] ABSTRACT

A straightener for removing dents from an installed section of pipe. The inventive device includes a tapered body positionable within the pipe. A vibrating assembly within the body removes dents from the pipe as the device is pulled therethrough.

9 Claims, 4 Drawing Sheets

VIBRATING PIPE STRAIGHTENER

BACKGROUND OF THE INVENTION

1. Field of the Invention

The present invention relates to pipe straightening devices and more particularly pertains to an vibrating pipe straightener for removing dents from an installed section of pipe.

2. Description of the Prior Art

The use of pipe straightening devices is known in the prior art. More specifically, pipe straightening devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art pipe straightening devices include U.S. Pat. No. 4,602,495; U.S. Pat. No. 3,466,921; U.S. Pat. No. 4,974,440; and U.S. Pat. No. 5,205,150.

While these devices fulfill their respective, particular objectives and requirements, the aforementioned patents do not disclose a vibrating pipe straightener for removing dents from an installed section of pipe which includes a tapered body positionable within the pipe, and a vibrating assembly within the body which removes dents from the pipe as the device is pulled therethrough.

In these respects, the vibrating pipe straightener according to the present invention substantially departs from the conventional concepts and designs of the prior art, and in so doing provides an apparatus primarily developed for the purpose of removing dents from an installed section of pipe.

SUMMARY OF THE INVENTION

In view of the foregoing disadvantages inherent in the known types of pipe straightening devices now present in the prior art, the present invention provides a new vibrating pipe straightener construction wherein the same can be utilized for removing dents from a section of pipe. As such, the general purpose of the present invention, which will be described subsequently in greater detail, is to provide a new vibrating pipe straightener apparatus and method which has many of the advantages of the pipe straightening devices mentioned heretofore and many novel features that result in a vibrating pipe straightener which is not anticipated, rendered obvious, suggested, or even implied by any of the prior art pipe straightening devices, either alone or in any combination thereof.

To attain this, the present invention generally comprises a straightener for removing dents from an installed section of pipe. The inventive device includes a tapered body positionable within the pipe. A vibrating assembly within the body removes dents from the pipe as the device is pulled therethrough.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new vibrating pipe straightener apparatus and method which has many of the advantages of the pipe straightening devices mentioned heretofore and many novel features that result in a vibrating pipe straightener which is not anticipated, rendered obvious, suggested, or even implied by any of the prior art pipe straightening devices, either alone or in any combination thereof.

It is another object of the present invention to provide a new vibrating pipe straightener which may be easily and efficiently manufactured and marketed.

It is a further object of the present invention to provide a new vibrating pipe straightener which is of a durable and reliable construction.

An even further object of the present invention is to provide a new vibrating pipe straightener which is susceptible of a low cost of manufacture with regard to both materials and labor, and which accordingly is then susceptible of low prices of sale to the consuming public, thereby making such vibrating pipe straighteners economically available to the buying public.

Still yet another object of the present invention is to provide a new vibrating pipe straightener which provides in the apparatuses and methods of the prior are some of the advantages thereof, while simultaneously overcoming some of the disadvantages normally associated therewith.

Still another object of the present invention ms to provide a new vibrating pipe straightener for removing dents from an installed section of pipe.

Yet another object of the present invention is to provide a new vibrating pipe straightener which includes a tapered body positionable within the pipe, and a vibrating assembly within the body which removes dents from the pipe as the device is pulled therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will, become apparent when consideration is given to the following detailed description thereof. Such description makes reference to the annexed drawings wherein.

DESCRIPTION OF THE PREFERRED EMBODIMENT

Figure 1:
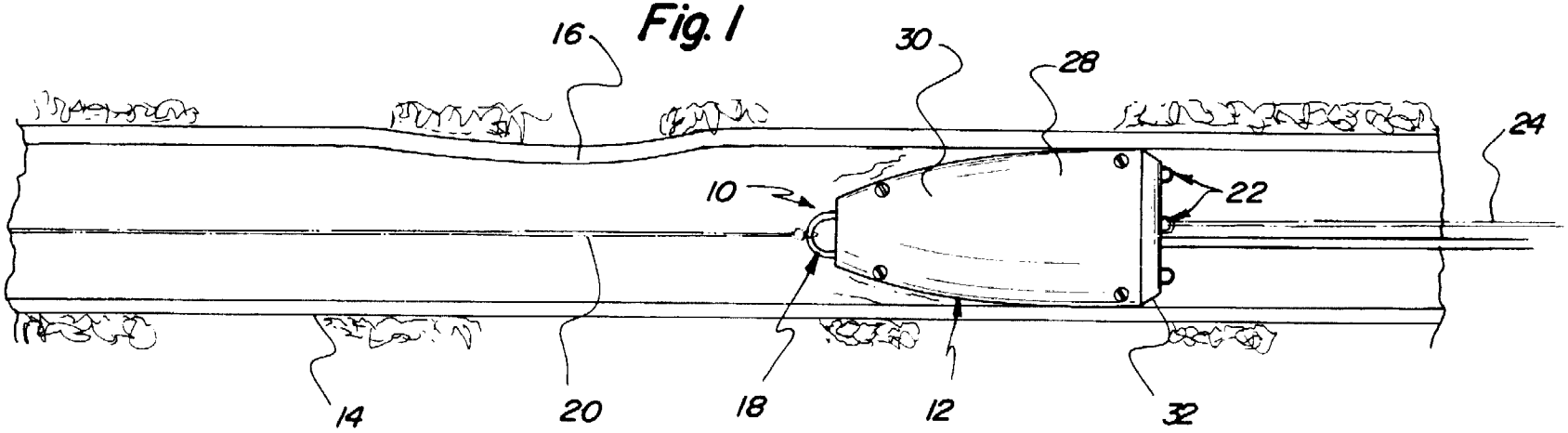
FIG. 1 is a side elevation view of a vibrating pipe straightener according to the present invention in use.
Figure 2:
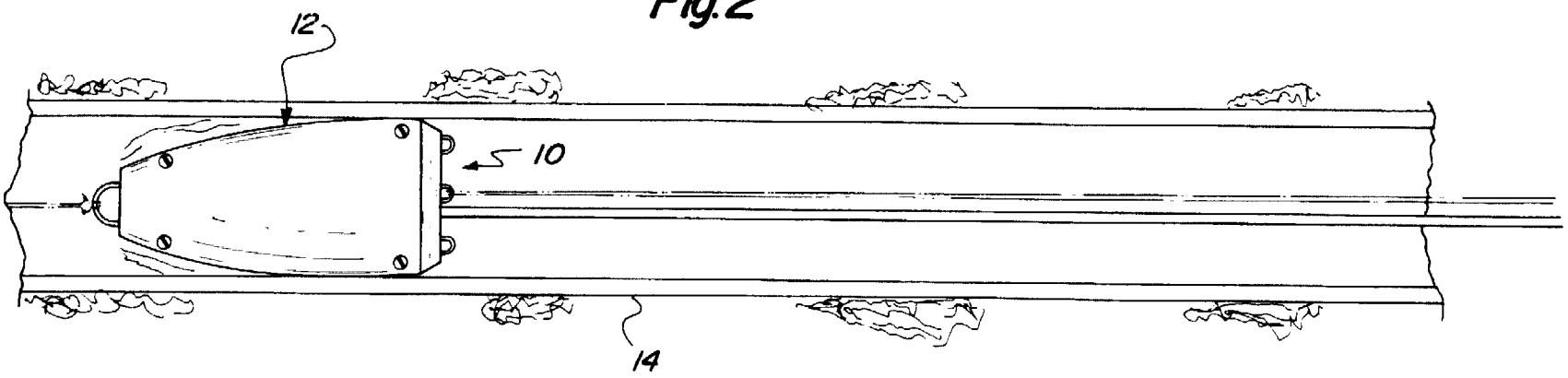
FIG. 2 is a further side elevation view of the device in use.

With reference now to the drawings, and in particular to FIGS. 1–8 thereof, a new vibrating pipe straightener embodying the principles and concepts of the present invention and generally designated by the reference numeral 10 will be described.

Figure 3:
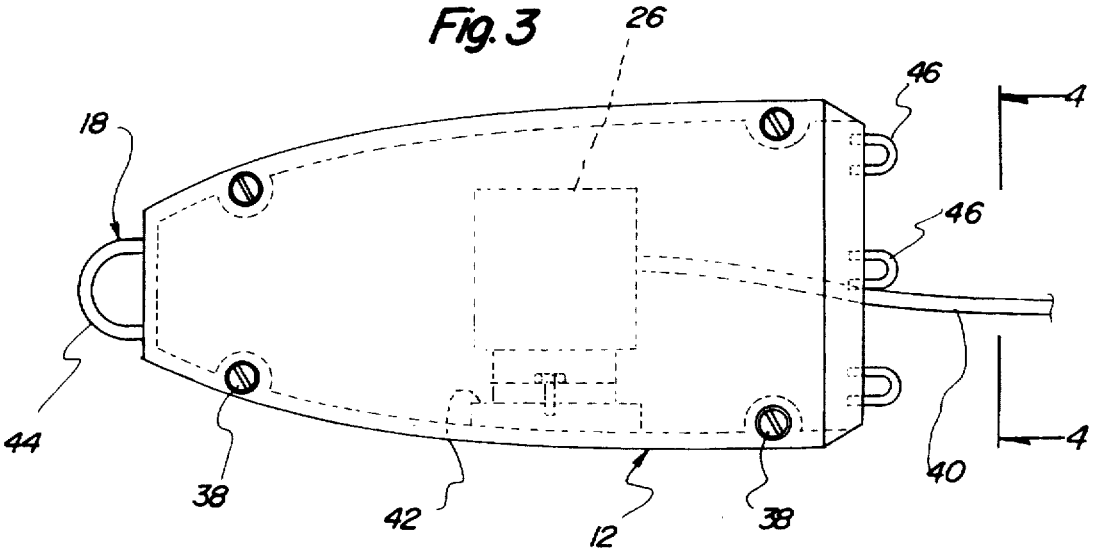
FIG. 3 is a side elevation view of the invention, per se.
Figure 4:
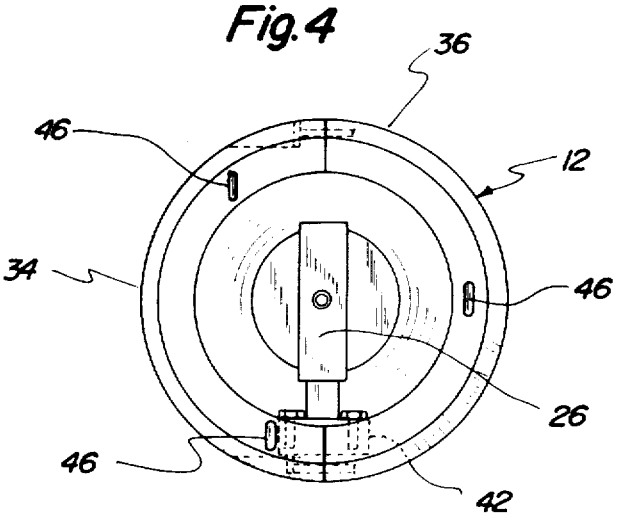
FIG. 4 is an end elevation view of the invention as seen from line 4—4 of FIG. 3.
Figure 5:
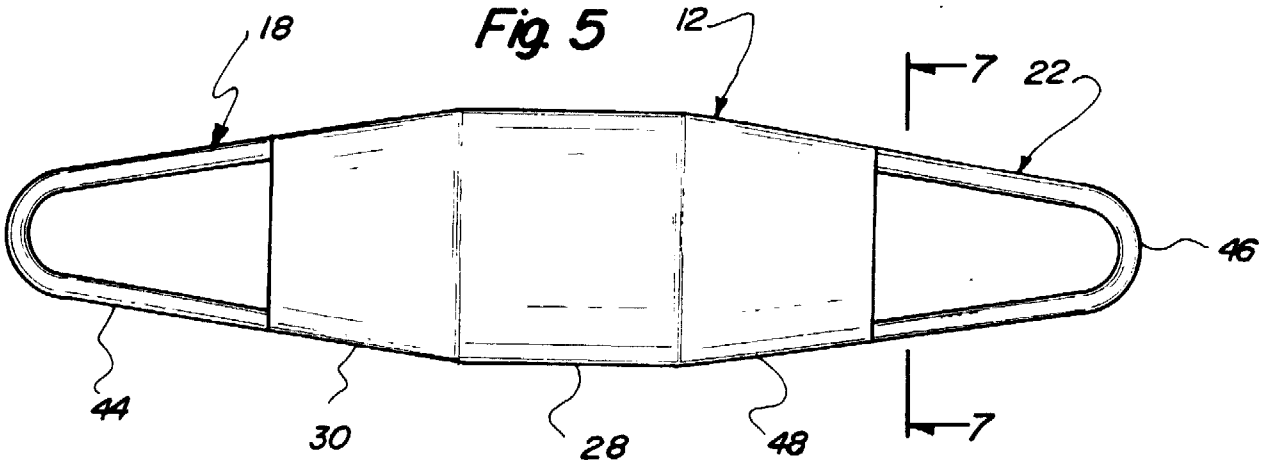
FIG. 5 is a top plan view of an alternative form of the present invention.
Figure 6:
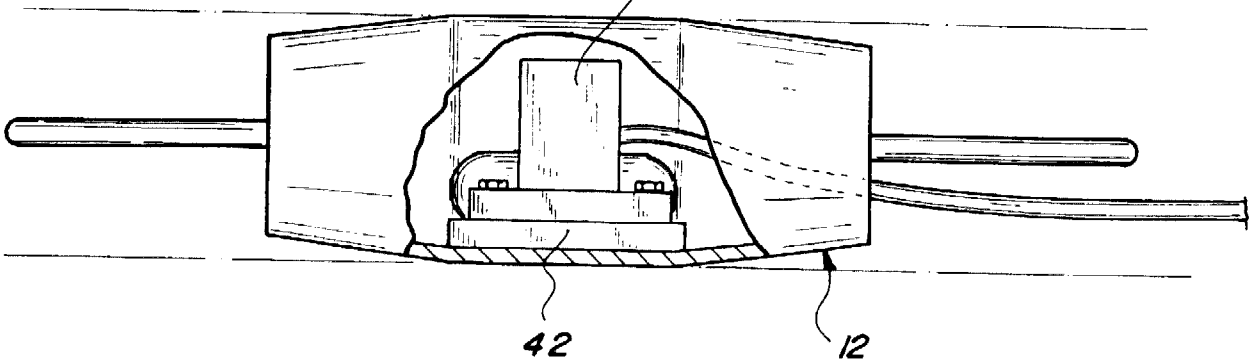
FIG. 6 is a side elevation view of the alternative form.
Figure 7:
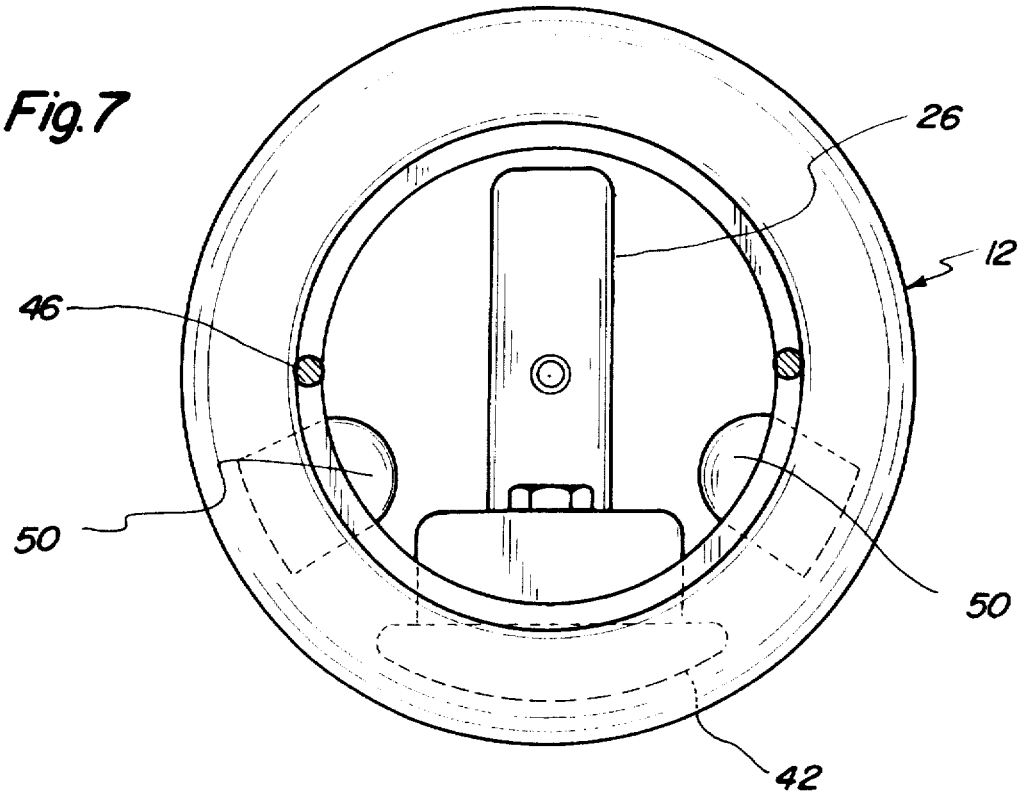
FIG. 7 is a cross sectional view taken along line 7—7 of FIG. 5.

More specifically, it will be noted that the vibrating pipe straightener 10 comprises a tapered body 12 positionable within a section of pipe 14 having a dent 16 needing to be removed. The tapered body 12 is shaped so as to define a maximum outside diameter substantially equal to an inside diameter of the pipe 14. A leading line mounting means 18 is secured to a front end of the tapered body 12 for coupling to a leading line 20 to facilitate pulling of the tapered body 12 through the inside of the pipe 14. To facilitate removal of the tapered body 12 subsequent to use of the device 10, the present invention may further comprise trailing line mounting means 22 for mounting to a trailing line 24 which can be tensioned to pull. The device 10 from the pipe 14. As shown in FIGS. 3 and 4, the present invention 10 includes a vibrator 26 mounted within the tapered body 12 which cooperates with the tapered body to effect vibrating impacting of the tapered body 12 against a dent 16 in the pipe 14 to effect removal of such dent therefrom. By this structure, the present invention 10 can be pulled through a pipe 14 to remove dents 16 therefrom.

As best illustrated in FIGS. 1 through 4, it can be shown that the tapered body 12 according to the present invention 10 comprises a cylindrical section 28 having an outside diameter substantially equal no an inside diameter of the pipe 14 to which the device 10 is to be associated. A tapered leading section 30 extends forwardly of the cylindrical section 28 and reduces in diameter so as to define a tapered leading edge which initially contacts the dent 16 to be removed from the pipe 14. A truncated trailing section 32 projects from the cylindrical section 28 of the tapered body 12 in a direction opposite that of the tapered leading section 30 and is also characterized by a reduced cross sectional dimension facilitating ease of removal of the device 10 from the pipe 14 subsequent to use thereof. Preferably, the tapered body 12 is comprised of a left half portion 34 removably coupled to a right half portion 36 by a plurality of fasteners 38 directed therethrough so as to permit access to the vibrator 26 positioned within the tapered body 12.

As shown in FIGS. 3 and 4, the vibrator 26 includes a power supply cord 40 extending therefrom for supplying electrical, pneumatic, or hydraulic power to the associated vibrator. A vibrating pad 42 of the vibrator 26 is secured to an interior surface of the tapered body 12 by a plurality of unlabeled fasteners directed through the vibrating pad and threadably engaged to the tapered body. By this structure, vibrations or mechanical oscillations generated by the vibrator 26 will be transferred to the tapered body 12 to facilitate removal of a dent 16 from an associated pipe 14 during use of the device 10.

With continuous reference to FIGS. 3 and 4, it can be shown that the leading line mounting means 18 according to the present invention 10 preferably comprises a leading line mounting loop 44 secured to a front end of the tapered leading section 30 of the tapered body 12. Similarly, the trailing line mounting means 22 comprises at least one trailing line mounting loop 46 secured to the truncated trailing section 32 of the tapered body 12. Preferably and as shown in FIG. 4, the trailing line mounting means 22 comprises a plurality of trailing mounting loops 46 secured in a radially spaced relationship to the truncated trailing section 32. Such mounting of the trailing line mounting loops 46 permits the attachment of multiple lines 24 to the tapered body 12 to facilitate pulling of the tapered body in a desired direction.

Referring now to FIGS. 5 through 8 wherein an alternative form of the present invention 10 is illustrated in detail, it can be shown that the tapered body 12 may alternatively comprise a tapered trailing section 48 of substantially similar configuration relative to the tapered leading section 30. In a similar manner, the trailing line mounting means 22 comprises a single trailing line mounting loop 46 mounted to the tapered trailing section 48 to impart a symmetrical appearance to the tapered body 12 and line mounting means 18 and 22. Further and as shown for the alternative form of the present invention 10, either form of the present invention may include balancing weights 50 mounted within the tapered body 12 and arranged so as to extend along laterally opposed edges of the vibrating pad 42. The balancing weights 50 cooperate with the vibrator 26 to maintain the tapered body 12 in a desired orientation within a pipe 14. By this structure, the vibrator 26 is maintained in an orthogonal orientation relative to upper surface dents commonly found within buried or underground pipe 14, as shown in FIG. 1, to provide for ease of removal of such dents 16 therefrom.

Figure 8:
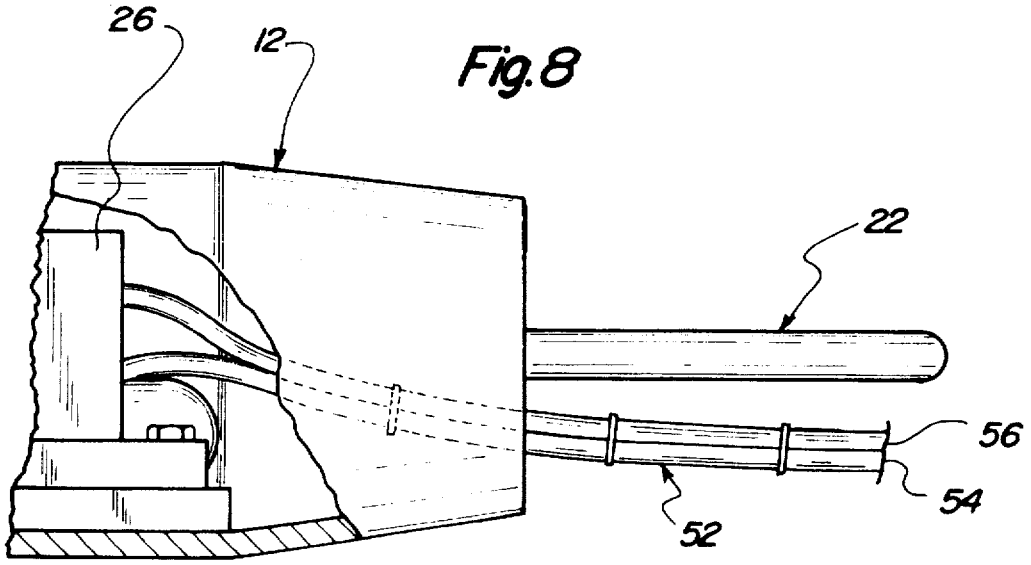
FIG. 8 is an enlarged side elevation view of a portion of the alternative form of the invention.

As shown in FIG. 8, the vibrator 26 may be pneumatic or hydraulically powered with a fluid conduit 52 providing fluid or hydraulic communication between the vibrator 26 and a pressurized fluid source. To this end, the fluid conduit 52 comprises a supply line 54 for supplying a pressurized fluid or gas to the vibrator 26, and a return line 56 for facilitating egress of such fluid or gas from the vibrator 26.

In use, the vibrating pipe straightener 10 according to the present invention can be easily utilized to effect removal of dents 16 from a section of pipe 14. The present invention 10 is particularly useful for use in straightening plastic or polymeric sewer pipes which are surround by a granular material, wherein the vibrating action of the vibrator 26 causes a redistribution of such granular material necessary during straightening of the dent 16 from the pipe 14.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A vibrating pipe straightener comprising:

a tapered body positionable within a pipe having a dent, the tapered body being shaped so as to define a maximum outside diameter substantially equal to an inside diameter of the pipe;

a leading line mounting means secured to a front end of the tapered body for coupling to a leading line to facilitate pulling of the tapered body through an interior of the pipe;

a vibrator means mounted within the tapered body which cooperates with the tapered body for effecting vibrating impacting of the tapered body against the dent in the pipe to effect removal of the dent therefrom;

a trailing line mounting means for mounting to a trailing line which can be tensioned to pull the straightener from wherein the tapered body comprises a cylindrical section; a tapered leading section extending forwardly of the cylindrical section and reducing in diameter so as to define a tapered leading edge which initially contacts a dent to be removed from a pipe; and a trailing section projecting from the cylindrical section of the tapered body in a direction opposite that of the tapered leading section.

2. The vibrating pipe straightener of claim 1, wherein the tapered body is comprised of a left half portion removably coupled to a right half portion.

3. The vibrating pipe straightener of claim 2, wherein the vibrator means includes a power supply cord extending therefrom; and a vibrating pad secured to an interior surface of the tapered body such that vibrations generated by the vibrator means will be transferred to the tapered body.

4. The vibrating pipe straightener of claim 3, wherein the leading line mounting means comprises a leading line mounting loop secured to a front end of the tapered leading section of the tapered body.

5. The vibrating pipe straightener of claim 4, wherein the trailing line mounting means comprises at least one trailing line mounting loop secured to the trailing section of the tapered body.

6. The vibrating pipe straightener of claim 5, wherein the trailing line mounting means comprises a plurality of trailing mounting loops secured in a radially spaced relationship to the trailing section.

7. The vibrating pipe straightener of claim 6, and further comprising balancing weights mounted within the tapered body and arranged so as to extend along laterally opposed edges of the vibrating pad.

8. A vibrating pipe straightener comprising:

a tapered body positionable within a pipe having a dent, the tapered body being shaped so as to define a maximum outside diameter substantially equal to an inside diameter of the pipe;

a vibrator means mounted within the tapered body which cooperates with the tapered body for effecting vibrating impacting of the tapered body against the dent in the pipe to effect removal of the dent therefrom;

wherein the tapered body comprises a cylindrical section; a tapered leading section extending forwardly of the cylindrical section and reducing in diameter so as to define a tapered leading edge which initially contacts a dent to be removed from a pipe.

9. A vibrating pipe straightener comprising:

a tapered body positionable within a pipe having a dent, the tapered body being shaped so as to define a maximum outside diameter substantially equal to an inside diameter of the pipe;

a vibrator means mounted within the tapered body which cooperates with the tapered body for effecting vibrating impacting of the tapered body against the dent in the pipe to effect removal of the dent therefrom, wherein all of said vibrator means is mounted within the tapered body.

* * * * *